US006755615B2

(12) United States Patent
Chapman

(10) Patent No.: US 6,755,615 B2
(45) Date of Patent: Jun. 29, 2004

(54) HIGH EFFICIENCY ONE-PIECE CENTRIFUGAL BLOWER

(75) Inventor: Thomas Chapman, Templeton, MA (US)

(73) Assignee: Robert Bosch Corporation, Broadview, IL (US)

( * ) Notice: Subject to any disclaimer, the term of this patent is extended or adjusted under 35 U.S.C. 154(b) by 62 days.

(21) Appl. No.: 10/005,031

(22) Filed: Dec. 4, 2001

(65) Prior Publication Data

US 2002/0106277 A1 Aug. 8, 2002

Related U.S. Application Data

(60) Provisional application No. 60/251,211, filed on Dec. 4, 2000.

(51) Int. Cl.[7] ..... F04D 29/30

(52) U.S. Cl. ..... 415/206; 415/213.1; 416/186 R; 416/223 B; 416/234; 417/423.1; 417/423.14

(58) Field of Search ..... 415/206, 211.2, 415/213.1, 915; 416/185, 186 R, 187, 189, 192, 223 B, 241 A, 234; 417/423.1, 423.14

(56) References Cited

U.S. PATENT DOCUMENTS 4,647,271 A 3/1987 Nagai et al.
5,927,947 A 7/1999 Botros
6,007,300 A 12/1999 Saeki et al.
6,042,335 A 3/2000 Amr

OTHER PUBLICATIONS

Copy of International Search Report—May 31, 2002.

*Primary Examiner*—Christopher Verdier
(74) *Attorney, Agent, or Firm*—Fish & Richardson, P.C.

(57) ABSTRACT

The arrangement features a centrifugal impeller that exhibits relatively high operating efficiency and high pressure capability, and can be easily constructed as a single piece. The arrangement is useful where relatively high operating efficiency and low cost construction are required, and it is particularly suited for manufacture by injection molding plastic. The impeller is characterized by: a) a hub that extends to a radius less than that of the impeller inlet, allowing one piece construction by an injection molding tool with no slides or action; b) blades that extend from a radius less than the hub radius at the base of the blades, allowing the base of the blades to connect to the hub; c) an impeller top shroud that has curvature in a plane that contains the impeller axis; and d) a cylindrical area ratio between 1.0 and 2.0. The blower assembly is characterized by a separate base plate positioned in close proximity to the base of the impeller blades. The base plate can be incorporated into a motor flange or a blower or motor housing.

39 Claims, 6 Drawing Sheets

HIGH EFFICIENCY ONE-PIECE CENTRIFUGAL BLOWER

This application claims the benefit of provisional application U.S. Ser. No. 60/251,211, filed Dec. 4, 2000.

TECHNICAL FIELD

This invention relates to the general field of centrifugal blowers, such as those used for automotive climate control.

BACKGROUND

Centrifugal impellers generally include multiple blades that turn incoming airflow toward the radial direction as it moves from the impeller inlet to the impeller outlet. The blades generally are attached to, and rotate with, a hub, which defines the airflow path on the base of the impeller (the side opposite the inlet). For two-piece impellers, the top of the airflow path is established by a top shroud, which also is attached to the blades and rotates with the blades and the hub.

In automotive climate control applications (i.e., heating, ventilation and air conditioning) centrifugal impellers generally can be placed into two categories: a) low cost, single-piece impellers; and b) higher cost, higher efficiency two-piece impellers. The single-piece impellers, because of their lower cost, generally are used much more often than two-piece impellers. Two-piece impellers generally are used where the need for high efficiency or high pressure capability outweighs the cost disadvantage.

In automotive climate control applications, centrifugal blowers should operate efficiently over a range of operating conditions. For example, duct passages open and close to direct air through different heat exchangers of different flow resistances. Flow resistance typically is greatest in heater and defrost conditions, and least in air conditioning mode. In some instances, the high flow resistance of heater and defrost modes can cause performance and noise problems for conventional one-piece impellers that may be less efficient or only capable of producing relatively low pressures.

Yapp, U.S. Pat. No. 4,900,228 discloses a two-piece impeller with rearwardly curved blades with "S" shaped camber.

Chapman (WO 01/05652) discloses a two-piece impeller with high blade camber.

SUMMARY

This invention provides blade and passage geometry found in two-piece centrifugal impellers in a design that can be injection molded as a single piece. The injection mold does not require any action or slides to mold the part.

In general, the invention features a centrifugal impeller constructed as a single part. The impeller includes three components: i) a plurality of blades, each having a leading edge and a trailing edge; ii) a generally annular top shroud connected to the tops of the blades, the top shroud having an inner radius; and iii) a hub connected to an inner portion of the base of the blades, the hub having an outer radius that is less than the inner radius of the top shroud, so that the blades, top shroud and hub can be constructed as a single unit. The invention is less expensive to manufacture than a two-piece impeller and operates more efficiently and at higher flow resistances than a conventional one piece impeller.

Another aspect of the invention is a blower assembly comprising the above described impeller and a base-plate, which, together, form an airflow path from an inlet to an outlet. The base-plate is non-rotating and extends outwardly to a radius greater than the impeller hub radius. The clearance between the base plate and the impeller blades is generally less than 10 percent of the radius of the bottoms of the blade trailing edges. In preferred embodiments, the base plate is curved in a plane which contains the impeller axis, and is contoured to match the contour of the base of the impeller blades as the impeller rotates.

In some preferred embodiments, the impeller is contained in a blower housing and said base plate is integrated into a portion of said blower housing as a single monolithic part. In some preferred embodiments, a motor is mounted to rotate the impeller, said motor being mounted to a motor flange, and said base plate is integrated into said motor flange as a single monolithic part. In some preferred embodiments, a motor is mounted to rotate the impeller, said motor being mounted in a motor housing, and said base plate is integrated into said motor housing as a single monolithic part. In some preferred embodiments, said motor housing is integrated into a portion of the blower housing as a single monolithic part.

In preferred embodiments, the blower assembly is sized and configured to be installed in an automotive climate control system.

In preferred embodiments, the impeller is characterized by:

a) a top shroud that has curvature in a plane that contains the impeller axis;
b) a cylindrical area ratio between 1.0 and 2.0;
c) an inlet to outlet area ratio between 0.7 and 1.0;
d) blades that make contact with the hub over less than 20% of the blade meanline length at the base of the blade;
e) a minimum blade chord length of 15% of the impeller diameter;
f) a blade solidity of at least 2.0;
g) tops of the blade leading edges that protrude radially inward to a radius 1–8 millimeters less than the impeller inlet radius;
h) a top shroud that covers the blades over at least 50% of the radial extent of the blades that is greater than the impeller inlet radius, and;
i) a top shroud that incorporates a ring that is used to control the recirculation through the clearance between the impeller and the blower housing.

The invention features a method of injection-molding the above-described impeller as a single piece. It also features a method of assembling a blower assembly in which a motor is attached to a motor housing, a motor flange, or a portion of a blower housing in which a base plate has been integrated, and the above-described impeller is attached to the motor in such a way as to control the clearance between the impeller and the base plate.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
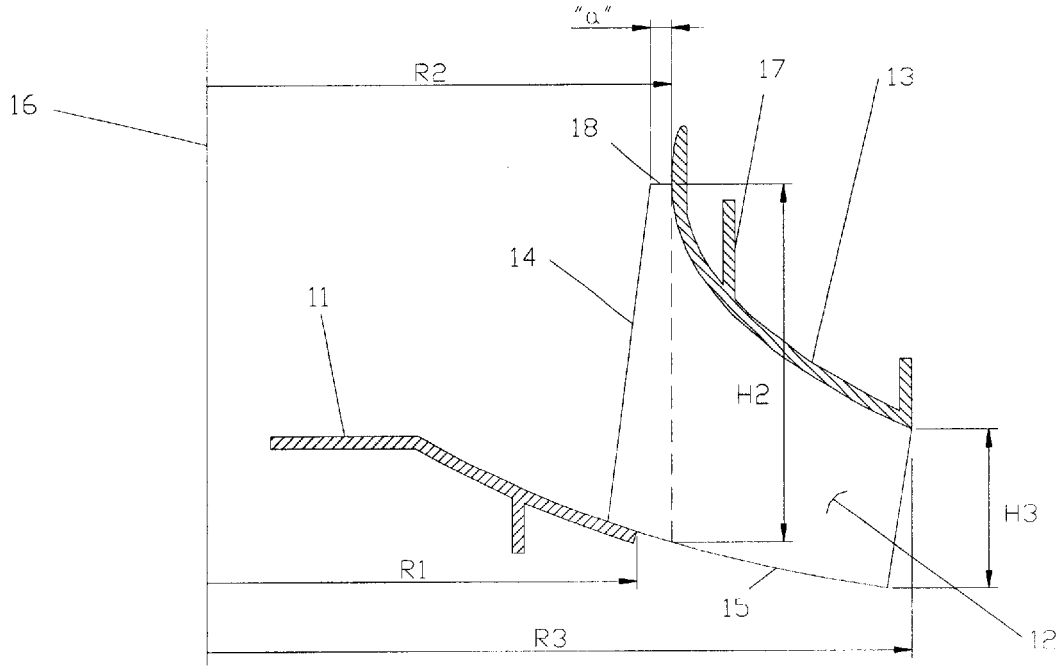
FIG. 1 is a half cross section view of one embodiment of the impeller, said cross section being in a plane that contains the impeller axis. The cross section includes a swept view of a blade, showing the envelope of the blade as the impeller rotates. The impeller hub and top shroud shapes are shown.

FIG. 1 is a half cross section view of one embodiment of the impeller, said cross section being in a plane that contains the impeller axis 16. The cross section includes a swept view of a blade. The impeller comprises a hub 11, the blades 12, and the impeller top shroud 13.

The impeller hub 11 extends to a radius R1 that is less than the inlet radius R2, allowing one piece construction by an injection molding tool with no slides or other action.

The blade leading edges 14 extend from a radius less than the impeller hub radius R1 at the base of the blades 15, allowing the base of the blades to connect to the impeller hub 11.

The impeller top shroud 13 covers the blades and has curvature in a plane that contains the impeller axis 16. The curvature of the top shroud is designed to optimize smooth airflow through the impeller. The impeller top shroud is necessary as a structural part of the impeller. The impeller top shroud also helps to prevent flow separation and turbulence, and limits the recirculation of the flow exiting the impeller back into the blades, which results in lower operating efficiency. In preferred embodiments, the impeller top shroud can incorporate a ring 17 to provide a longer and more resistive flow path for the recirculating flow, thus reducing the amount of flow recirculating back into the impeller inlet. Additional rings can be used to further reduce the amount of recirculating flow. Also in preferred embodiments, the impeller top shroud covers over 50% of the radial extent of the blades greater than the impeller inlet radius R2.

The radius of the impeller inlet R2 and the height of the blade at that radius H2 define an inlet cylinder the area of which is $2\pi R2H2$. The radius of the tops of the blade trailing edges R3 and the height of the blade trailing edges H3 define an outlet cylinder the area of which is $2\pi R3H3$. The cylindrical area ratio is the ratio of the area of the inlet cylinder to that of the outlet cylinder. In the preferred embodiment, the impeller cylindrical area ratio is between 1.0 and 2.0, i.e., $$1.0<R2H2/R3H3<2.0$$

This relationship helps prevent flow separation from the top shroud surface, enabling a relatively high blower operating efficiency.

The impeller inlet area is defined as the area of a circle of radius R2. The impeller outlet area is defined as the area of a cylinder of radius R3 and height H3. The impeller inlet to outlet ratio is the ratio of these two areas. In the preferred embodiment, the impeller inlet to outlet area ratio is between 0.7 and 1.0, i.e., $$0.7<\pi(R2)^2/2\pi R3H3<1.0$$

This relationship also helps prevent flow separation from the top shroud surface, enabling a relatively high blower operating efficiency.

The blade leading edge at the top of the blade protrudes radially inward to a radius less than that of the inlet. The difference between the radius of the blade leading edge at the top of the blade and the inlet radius is shown as "a". This geometry allows the half of the tool that molds the majority of the blades to extend axially to the top edge 18 of the blades 12. The two tool halves meet along this edge. In the preferred embodiment, dimension "a" is 1–8 millimeters.

Figure 2:
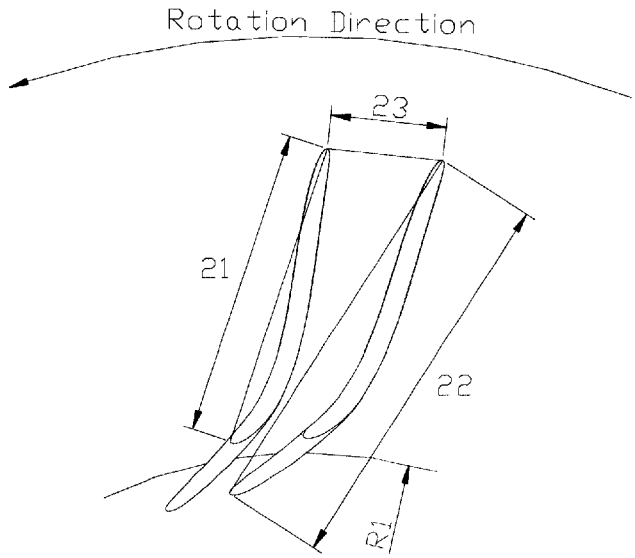
FIG. 2 is a view of two impeller blades, said view being in a plane normal to the impeller axis. The view shows the blade chord at the top of the blade, the blade chord at the base of the blade, and the blade trailing edge spacing.

FIG. 2 shows a view of two impeller blades, said view being in a plane normal to the impeller axis. The view shows the blade chord at the top of the blade 21, the blade chord at the base of the blade 22, and the blade trailing edge spacing 23. The blade chord at the top of the blade 21 is defined as the projection of a line from the leading edge at the top of the blade to the trailing edge at the top of the blade, onto a plane normal to the impeller axis. Likewise, the blade chord at the base of the blade 22 is defined as the projection of a line from the leading edge at the base of the blade to the trailing edge at the base of the blade, onto a plane normal to the impeller axis. The minimum blade chord is the shorter of these two chords. A minimum blade chord of at least 15% of the impeller diameter helps provide operating efficiencies significantly higher than conventional single piece impellers. The impeller diameter is typically determined by the diameter of the blade trailing edges at their greatest radial extent.

Another important feature for high efficiency is high blade solidity. Blade solidity is defined as the ratio of the minimum blade chord length to the space between the blades at the furthest radial extent of the trailing edge. A blade solidity of at least 2.0 is optimal for efficient operation. Blade solidity is limited by the same phenomenon that limits blade chord length, i.e., the blade passages become so narrow as to block the airflow from progressing through the impeller, reducing operating efficiency.

Figure 3:
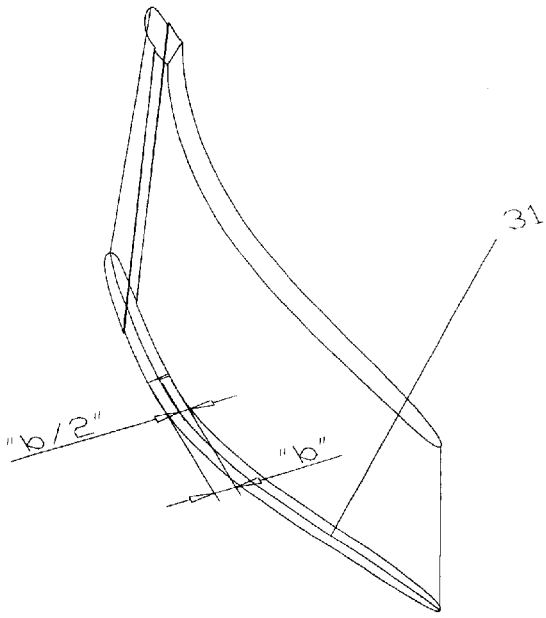
FIG. 3 is perspective view of an impeller blade showing the blade meanline at the base of the blade.

FIG. 3 is a perspective view of an impeller blade, showing the blade meanline at the base of the blade 31. The blade meanline at the base of the blade is defined as the line from the leading edge to the trailing edge, along the base of the blade, equidistant from both sides of the blade. In the preferred embodiment, the blades make contact with the impeller hub over no more than 20% (e.g., the first 20%) of the blade meanline at the base of the blade.

Figure 4:
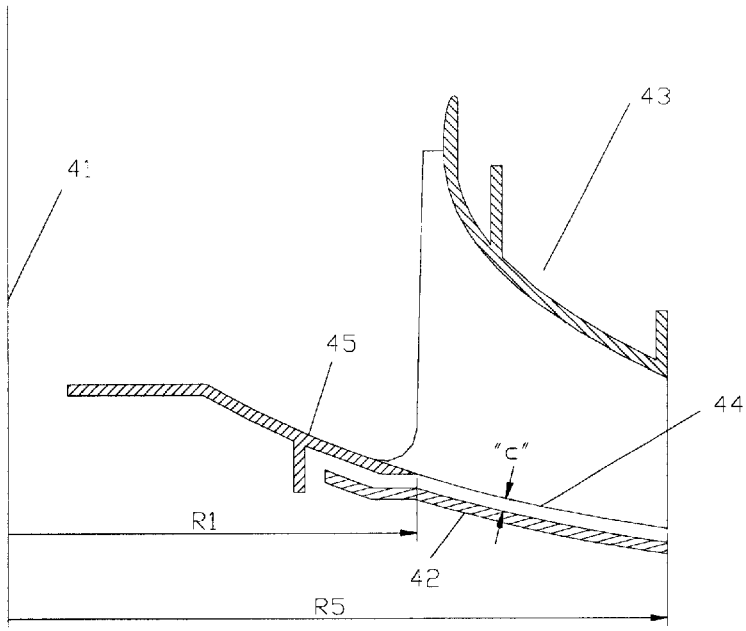
FIG. 4 is a half cross section view of another embodiment of the impeller with a base plate, said cross section being in a plane that contains the impeller axis. The cross section includes a swept view of a blade. The preferred embodiment of a base plate is shown.

FIG. 4 is a half cross section view of a blower assembly comprising an impeller 43 and a base plate 42, said cross section being a plane that contains the impeller axis 41. The cross section view of the impeller 43 includes a swept view of a blade. Base plate 42 extends radially beyond impeller hub radius R1, and in preferred embodiments extends to the outer radius, R5, of the base of the impeller blade 44, as shown. The base plate 42 is positioned just below the impeller 43 and the base plate is contoured to match the contour of the base of the impeller blades 44. The perpendicular distance between the base plate 42 and the base of the impeller blades 44 is shown in FIG. 4 as "c". In order to be effective in establishing the airflow path through the impeller, "c" should be generally less than 10 percent of radius R5. In the preferred embodiment, the efficiency of the blower is maximized by positioning the base plate as close to the impeller as manufacturing tolerances allow. Automotive climate control impellers have radii generally ranging from 60 to 130 mm. For a typical impeller with a radius of 100 mm, clearance "c" should be between 1 and 10 mm.

Figure 5:
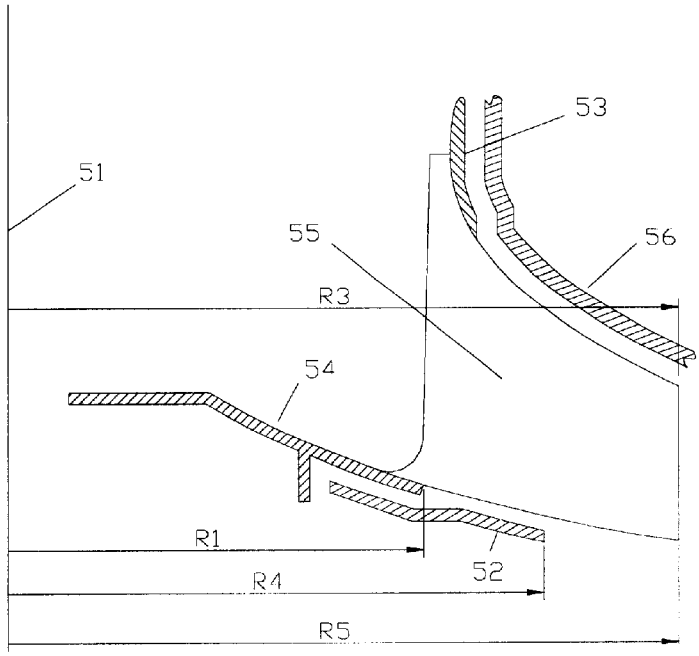
FIG. 5 is a half cross section view of another embodiment of the impeller with a base plate, said cross section being in a plane that contains the impeller axis. The cross section includes a swept view of a blade and a portion of a blower housing. A second embodiment of the base plate is shown.

FIG. 5 is a half cross section view of another blower assembly comprising an impeller with a base plate, said cross section being a plane that contains the impeller axis 51. The cross section view of the impeller 54 includes a swept view of a blade 55. This embodiment includes another embodiment of the base plate 52, as well as another embodiment of the top shroud 53. This base plate 52 has a radius R4 less than the radius R5 of the base of the impeller blade 55. The base plate can be effective at any radius larger than the impeller hub radius R1. The top shroud 53 has an outer radius less than the radius R3 of top of the impeller blade 55. A portion of a blower housing 56 is shown. When the radial extent of the top shroud 53 is substantially less than the radius R3 of the top of the impeller blade 55, a portion of the blower housing 56 must be in close proximity of the tops of the impeller blades 55 in order to limit recirculation.

Figure 6:
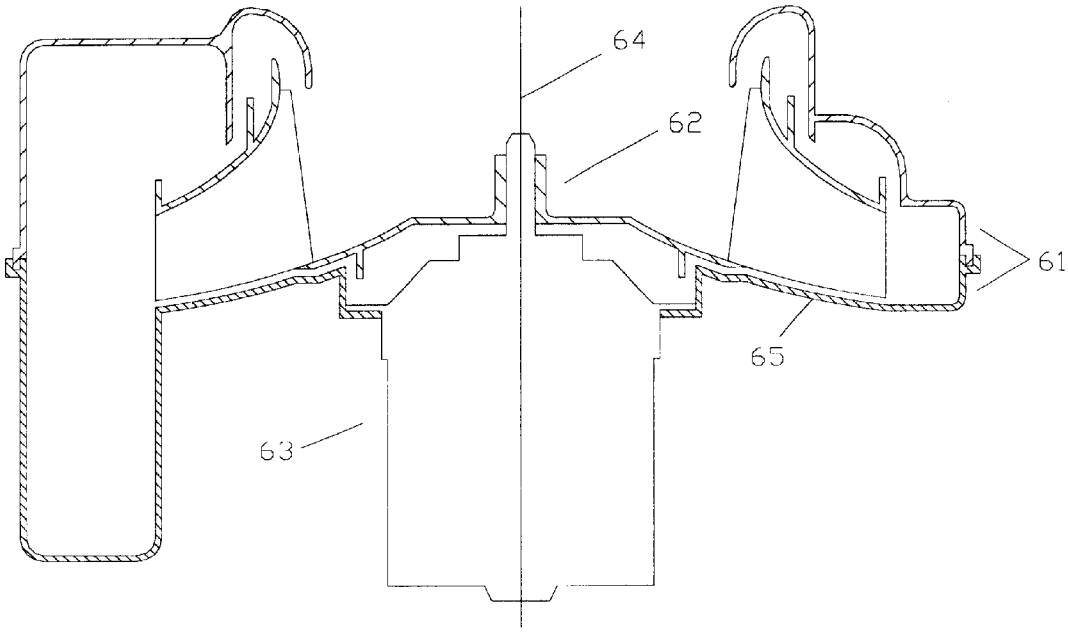
FIG. 6 is a cross section view of an assembly containing a blower housing, a motor, and an impeller, said cross section being in a plane that contains the impeller axis. The cross section includes a swept view of the impeller blades. An embodiment of the base plate integrated into a portion of the blower housing is shown.

FIG. 6 is a cross section view of a blower assembly, comprising a blower housing 61, impeller 62, and motor 63, said cross section being a plane that contains the impeller axis 64. The cross section view of the assembly includes a swept view of the blades. In this embodiment, the base plate 65 is incorporated into one portion of the blower housing 61, reducing the number of parts in the assembly.

Figure 7:
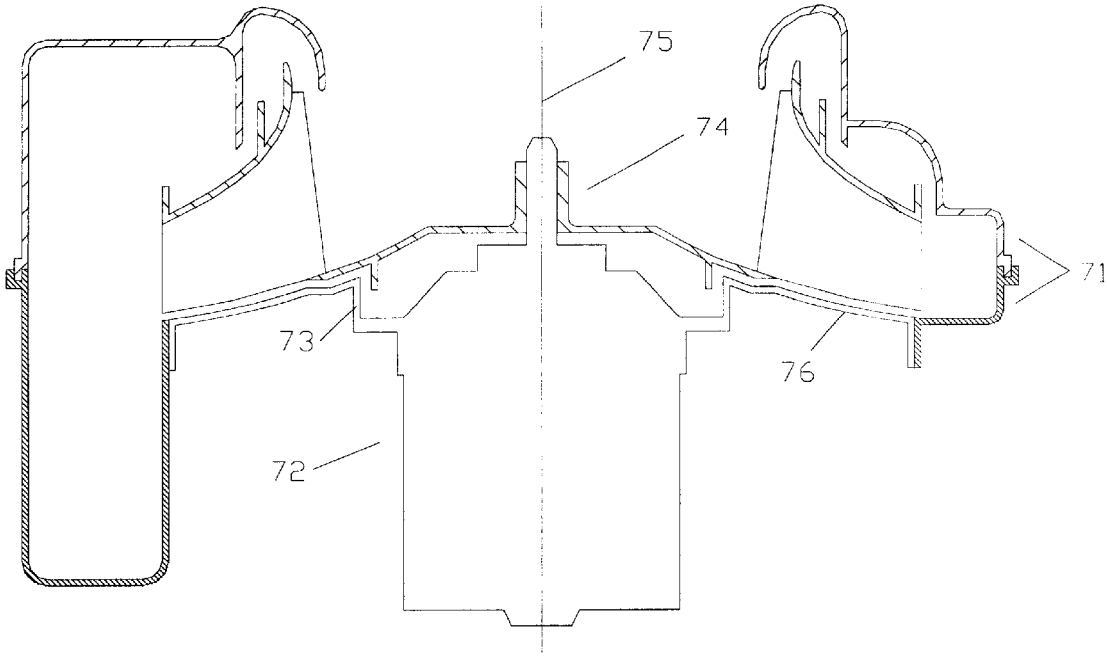
FIG. 7 is a cross section view of an assembly containing a blower housing, a motor, a motor flange, and an impeller, said cross section being in a plane that contains the impeller axis. The cross section includes a swept view of the impeller blades. An embodiment of the base plate integrated into the motor flange is shown.

FIG. 7 is a cross section view of a blower assembly, including a blower housing 71, a motor 72 with flange 73 and an impeller 74, said cross section being in a plane that contains the impeller axis 75. The cross section view includes a swept view of the impeller blades. In this embodiment, the base plate 76 is incorporated into the motor flange 73.

Figure 8:
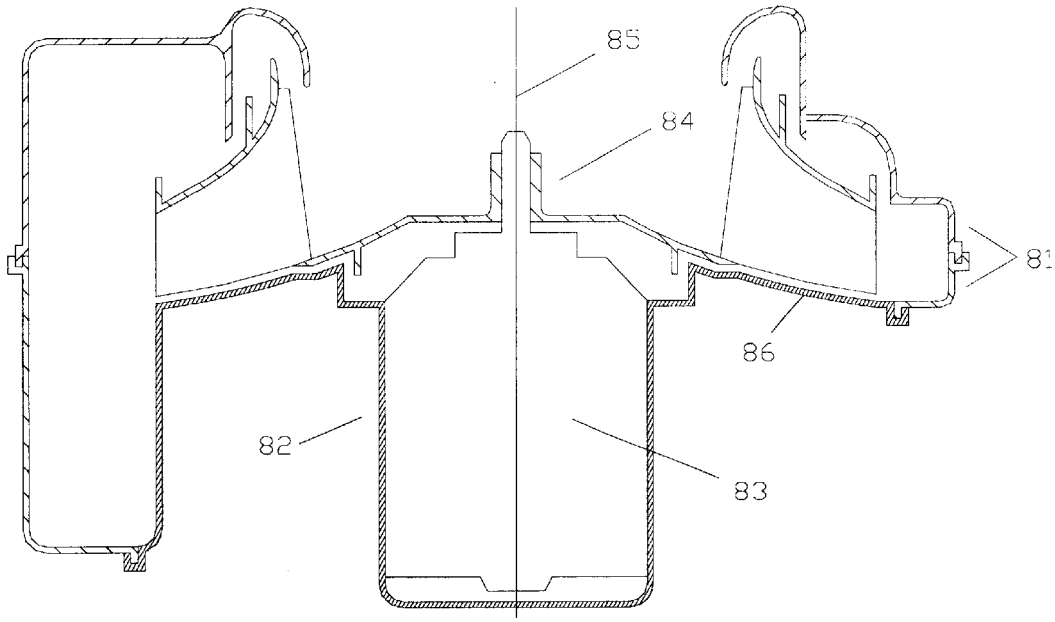
FIG. 8 is a cross section view of an assembly containing a blower housing, a motor housing, a motor and an impeller, said cross section being in a plane that contains the impeller axis. The cross section includes a swept view of the impeller blades. An embodiment of the base plate integrated into the motor housing is shown.

FIG. 8 is a cross section view of a blower assembly, including a blower housing 81, a motor housing 82, a motor, 83 and an impeller 84, said cross section being a plane that contains the impeller axis 85. The cross section view of the assembly includes a swept view of the blades. In this embodiment, the base plate 86 is incorporated into the motor housing 82.

Figure 9:
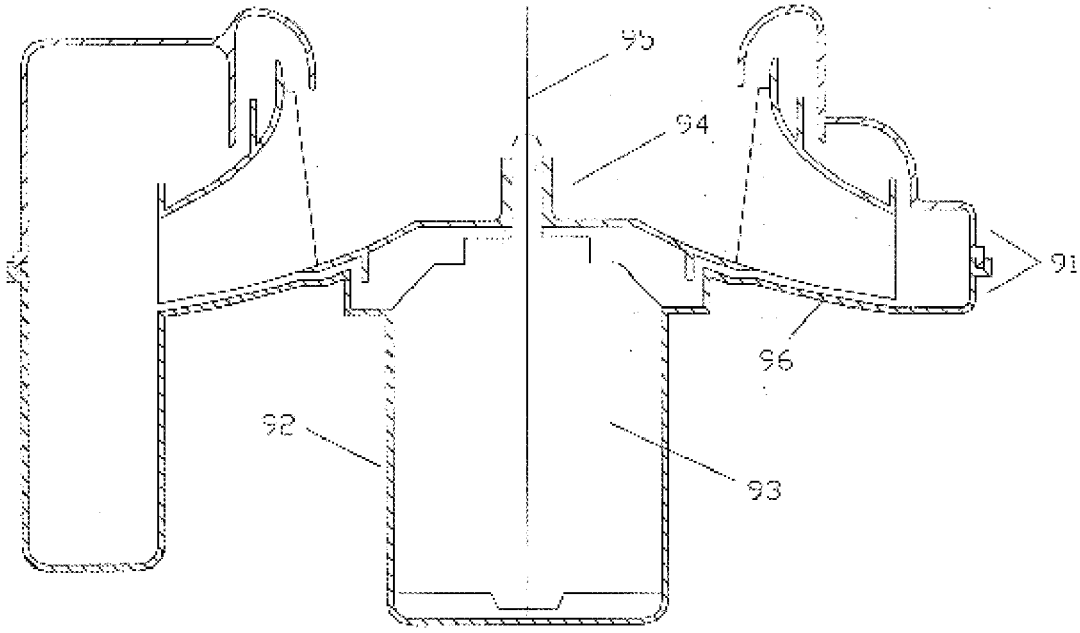
FIG. 9 is a cross section view of an assembly containing a blower housing, a motor housing, a motor and an impeller, said cross section being in a plane that contains the impeller axis. The cross section includes a swept view of the impeller blades. An embodiment of the base plate and a motor housing integrated into a portion of the blower housing is shown.

FIG. 9 is a cross section view of a blower assembly, including a blower housing 91, a motor housing 92, a motor 93, and an impeller 94, said cross section being in a plane that contains the impeller axis 95. The cross section view of the assembly includes a swept view of the blades. In this embodiment, the motor housing 92 and base plate 96 are incorporated into one portion of the blower housing 91.

Figure 10:
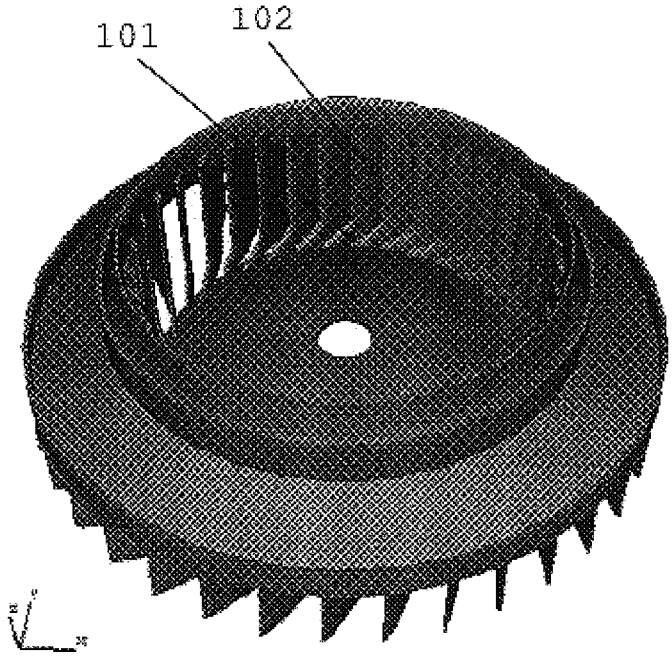
FIG. 10 is a perspective view of the impeller showing one possible blade leading edge shape.

FIG. 10 is a perspective view of the impeller showing one possible blade leading edge shape 102. The blade leading edge shape can vary to accommodate manufacturing needs. In this embodiment, most of the blade leading edge is nearly vertical, with a "foot" 101 attaching the blades to the hub.

Figure 11:
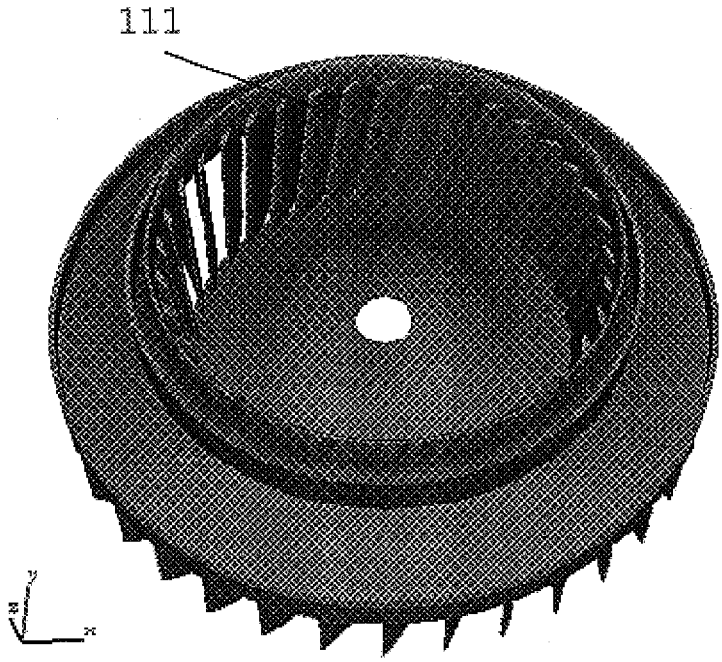
FIG. 11 is a perspective view of the impeller showing a second possible blade leading edge shape.

FIG. 11 is a perspective view of the impeller showing another possible blade leading edge shape 111. The blade leading edge shape can vary to accommodate manufacturing needs. In this embodiment, the leading edge is a constant angle over its span.

A number of embodiments of the invention have been described. Nevertheless, it will be understood that various modifications may be made without departing from the spirit and scope of the invention.

What is claimed is:

1. A centrifugal impeller mounted to rotate on an axis, the impeller comprising a plurality of blades, each having a leading edge and a trailing edge, an impeller hub, and a top shroud; the blades defining an impeller diameter, a cylindrical area ratio, a minimum chord length, a blade meanline length and a blade solidity; and the top shroud forming an inlet to the impeller having an impeller inlet radius; said impeller characterized in that:

a) it is injection molded in one piece;

b) the impeller hub extends outwardly to a radius less than that of the impeller inlet radius;

c) the blades extend outwardly from a radius less than the impeller hub radius;

d) the top shroud has curvature in a plane that contains the impeller axis;

e) the cylindrical area ratio is between 1.0 and 2.0; and f) said minimum chord length is at least 15% of the impeller diameter.

2. A centrifugal impeller mounted to rotate on an axis, the impeller comprising a plurality of blades, each having a leading edge and a trailing edge, an impeller hub, and a top shroud; the blades defining an impeller diameter, a cylindrical area ratio, a minimum chord length, a blade meanline length and a blade solidity; and the top shroud forming an inlet to the impeller having an impeller inlet radius; said impeller characterized in that:

a) it is injection molded in one piece;

b) the impeller hub extends outwardly to a radius less than that of the impeller inlet radius;

c) the blades extend outwardly from a radius less than the impeller hub radius;

d) the top shroud has curvature in a plane that contains the impeller axis;

e) the cylindrical area ratio is between 1.0 and 2.0; and f) said blade solidity is at least 2.0.

3. A centrifugal impeller mounted to rotate on an axis, the impeller comprising a plurality of blades, each having a leading edge and a trailing edge, an impeller hub, and a top shroud; the blades defining an impeller diameter, a cylindrical area ratio, a minimum chord length, a blade meanline length and a blade solidity; and the top shroud forming an inlet to the impeller having an impeller inlet radius; said impeller characterized in that:

a) it is injection molded in one piece;

b) the impeller hub extends outwardly to a radius less than that of the impeller inlet radius;

c) the blades extend outwardly from a radius less than the impeller hub radius;

d) the top shroud has curvature in a plane that contains the impeller axis;

e) the cylindrical area ratio is between 1.0 and 2.0; and f) said blades make contact with the hub over less than 20% of the meanline length at the base of the blades.

4. The centrifugal impeller of claim 1, claim 2 or claim 3 further characterized in that said top shroud incorporates at least one ring for the control of flow recirculation.

5. The centrifugal impeller of claim 1, claim 2 or claim 3 further characterized in that said top shroud covers the blades over at least 50% of the radial extent of the blades that is greater than the impeller inlet radius.

6. The centrifugal impeller of claim 1, claim 2 or claim 3 further characterized in that the tops of the blade leading edges protrude inwardly to a radius less than the impeller inlet radius.

7. The centrifugal impeller of claim 2 or 3 further characterized in that said minimum chord length is at least 15% of the impeller diameter.

8. The centrifugal impeller of claim 3 further characterized in that said blade solidity is at least 2.0.

9. The centrifugal impeller of claim 1 further characterized in that said blade solidity is at least 2.0 and said blades make contact with the hub over less than 20% of the meanline length at the base of the blades.

10. The centrifugal impeller of claim 1, claim 2 or claim 3 further characterized in that the tops of the blade leading edges protrude inwardly to a radius 1–8 millimeters less than the impeller inlet radius.

11. The centrifugal impeller of claim 1, claim 2 or claim 3 further characterized in that the impeller has an inlet with an inlet area and an outlet with an outlet area, and the ratio of the inlet area to the outlet area is between 0.7 and 1.0.

12. A centrifugal blower assembly comprising a base plate and the impeller of claim 1, claim 2 or claim 3, said impeller top shroud and base plate together forming an airflow path from an inlet to an outlet; said base plate being characterized in that:

1) it extends outwardly to a radius greater than the impeller hub radius;

2) it is non-rotating, and;

3) the clearance between the base plate and the impeller blades is less than 10 percent of the impeller radius.

13. The centrifugal blower assembly of claim 12 further comprising a blower housing and further characterized in that the base plate is integrated into a portion of said blower housing as a single monolithic part.

14. The centrifugal blower assembly of claim 12 further comprising a motor and a motor flange, further characterized in that the base plate is integrated into said flange as a single monolithic part.

15. The centrifugal blower assembly of claim 12 further comprising a motor housing and further characterized in that the base plate is integrated into said motor housing as a single monolithic part.

16. The centrifugal blower assembly of claim 15 further comprising a blower housing and further characterized in that the motor housing is integrated into a portion of said blower housing as a single monolithic part.

17. The centrifugal blower assembly of claim 12 further characterized in that said base plate is contoured in combination with said impeller to match the contour of the base of the impeller blades as the impeller rotates, establishing said airflow path.

18. The centrifugal blower assembly of claim 12 further characterized in that said base plate is curved in a plane that includes the fan axis.

19. A method of making the centrifugal impeller of claim 1 claim 2 or claim 3 by injection-molding said impeller as a single piece.

20. A method of assembling the centrifugal blower assembly of claim 13 in which a motor is mounted to said portion of said blower housing, and said impeller is attached to said motor.

21. A method of assembling the centrifugal blower assembly of claim 14 in which said motor is mounted to said motor flange, and said impeller is attached to said motor.

22. A method of assembling the centrifugal blower assembly of claim 15 in which a motor is mounted to said motor housing, and said impeller is attached to said motor.

23. A method of assembling the centrifugal blower assembly of claim 16 in which a motor is mounted to said motor housing, and said impeller is attached to said motor.

24. A centrifugal blower assembly according to 13 which is sized and configured to be installed in an automotive climate control system.

25. A centrifugal blower assembly according to 14 which is sized and configured to be installed in an automotive climate control system.

26. A centrifugal blower assembly according to claim 15 which is sized and configured to be installed in an automotive climate control system.

27. A centrifugal blower assembly according to claim 16 which is sized and configured to be installed in an automotive climate control system.

28. A centrifugal blower assembly comprising a base plate and a centrifugal impeller;

A. said impeller being mounted to rotate on an axis, the impeller comprising a plurality of blades, each having a leading edge and a trailing edge, an impeller hub, and a top shroud; the blades defining an impeller diameter, a cylindrical area ratio, a minimum chord length, a blade meanline length and a blade solidity; and the top shroud forming an inlet to the impeller having an impeller inlet radius; said impeller characterized in that:

1) it is injection molded in one piece;

2) the impeller hub extends outwardly to a radius less than that of the impeller inlet radius;

3) the blades extend outwardly from a radius less than the impeller hub radius;

4) the top shroud has curvature in a plane that contains the impeller axis, and;

5) the cylindrical area ratio is between 1.0 and 2.0; and

B. said base plate being characterized in that:

1) it extends outwardly to a radius greater than the impeller hub radius;

2) it is non-rotating, and;

3) the clearance between the base plate and the impeller blades is less than 10 percent of the impeller radius, said impeller top shroud and base plate together forming an airflow path from an inlet to an outlet, said assembly further comprising a motor and a motor flange, said base plate being integrated into said flange as a single monolithic part.

29. A centrifugal blower assembly comprising a base plate and a centrifugal impeller;

A. said impeller being mounted to rotate on an axis, the impeller comprising a plurality of blades, each having a leading edge and a trailing edge, an impeller hub, and a top shroud; the blades defining an impeller diameter, a cylindrical area ratio, a minimum chord length, a blade meanline length and a blade solidity; and the top shroud forming an inlet to the impeller having an impeller inlet radius; said impeller characterized in that:

1) it is injection molded in one piece;
2) the impeller hub extends outwardly to a radius less than that of the impeller inlet radius;
3) the blades extend outwardly from a radius less than the impeller hub radius;
4) the top shroud has curvature in a plane that contains the impeller axis, and;
5) the cylindrical area ratio is between 1.0 and 2.0; and B. said base plate being characterized in that:

1) it extends outwardly to a radius greater than the impeller hub radius;
2) it is non-rotating, and;
3) the clearance between the base plate and the impeller blades is less than 10 percent of the impeller radius, said impeller top shroud and base plate together forming an airflow path from an inlet to an outlet, said assembly further comprising a motor housing and further characterized in that the base plate is integrated into said motor housing as a single monolithic part.

30. The centrifugal blower assembly of claim 29 further comprising a blower housing and further characterized in that the motor housing is integrated into a portion of said blower housing as a single monolithic part.

31. A centrifugal blower assembly comprising a base plate and a centrifugal impeller;

A. said impeller being mounted to rotate on an axis, the impeller comprising a plurality of blades, each having a leading edge and a trailing edge, an impeller hub, and a top shroud; the blades defining an impeller diameter, a cylindrical area ratio, a minimum chord length, a blade meanline length and a blade solidity; and the top shroud forming an inlet to the impeller having an impeller inlet radius; said impeller characterized in that:

1) it is injection molded in one piece;
2) the impeller hub extends outwardly to a radius less than that of the impeller inlet radius;
3) the blades extend outwardly from a radius less than the impeller hub radius;
4) the top shroud has curvature in a plane that contains the impeller axis, and;
5) the cylindrical area ratio is between 1.0 and 2.0; and B. said base plate being characterized in that:

1) it extends outwardly to a radius greater than the impeller hub radius;
2) it is non-rotating;
3) the clearance between the base plate and the impeller blades is less than 10 percent of the impeller radius,
4) said base plate is curved in a plane that includes the fan axis said impeller top shroud and base plate together forming an airflow path from an inlet to an outlet.

32. The centrifugal blower assembly of claim 31 further comprising a blower housing and further characterized in that the base plate is integrated into a portion of said blower housing as a single monolithic part.

33. The centrifugal blower assembly of claim 31 further comprising a motor and a motor flange, further characterized in that the base plate is integrated into said flange as a single monolithic part.

34. The centrifugal blower assembly of claim 31 further comprising a motor housing and further characterized in that the base plate is integrated into said motor housing as a single monolithic part.

35. The centrifugal blower assembly of claim 34 further comprising a blower housing and further characterized in that the motor housing is integrated into a portion of said blower housing as a single monolithic part.

36. The centrifugal blower assembly of claim 28, claim 29 or claim 31 further characterized in that said base plate is contoured in combination with said impeller to match the contour of the base of the impeller blades as the impeller rotates, establishing said airflow path.

37. A method of assembling the centrifugal blower assembly of claim 28 in which said motor is mounted to said motor flange, and said impeller is attached to said motor.

38. A method of assembling the centrifugal blower assembly of claim 29 or 30 in which a motor is mounted to said motor housing, and said impeller is attached to said motor.

39. A centrifugal blower assembly according to claim 28, claim 29, claim 30 or claim 31 which is sized and configured to be installed in an automotive climate control system.

* * * * *